US011963627B2

(12) United States Patent
Hinton

(10) Patent No.: US 11,963,627 B2
(45) Date of Patent: Apr. 23, 2024

(54) METHOD AND ASSEMBLY FOR ASSISTING SOMEONE TO OPERATE A ZIPPER

(71) Applicant: Herman Hinton, Pelham, AL (US)

(72) Inventor: Herman Hinton, Pelham, AL (US)

( * ) Notice: Subject to any disclaimer, the term of this patent is extended or adjusted under 35 U.S.C. 154(b) by 0 days.

(21) Appl. No.: 17/948,996

(22) Filed: Sep. 20, 2022

(65) Prior Publication Data

US 2024/0090691 A1 Mar. 21, 2024

(51) Int. Cl.
*A47G 25/90* (2006.01)

(52) U.S. Cl.
CPC ..... *A47G 25/902* (2013.01)

(58) Field of Classification Search
CPC . A47G 25/902; Y10T 24/2586; A44B 19/285; B65G 7/12
See application file for complete search history.

(56) References Cited

U.S. PATENT DOCUMENTS 782,302 A * 2/1905 Williams ..... B65G 7/12 294/82.33
1,640,102 A * 8/1927 Valliere ..... B65G 7/12 294/26
2,845,297 A 7/1958 Doop
2,888,728 A 6/1959 Lebermann
2,905,499 A * 9/1959 Lallier ..... B65G 7/12 294/26
3,017,680 A * 1/1962 Duncan ..... A47G 25/902 294/3.6
3,310,853 A 3/1967 Winn
3,501,073 A * 3/1970 Breithor ..... A47G 25/902 223/118
3,704,491 A 12/1972 Burgess
D296,882 S 7/1988 Lopez
5,316,356 A * 5/1994 Nutting ..... A01M 31/006 119/807
D406,685 S 3/1999 McGinnis
D696,154 S * 12/2013 McGinnis ..... D11/221
8,702,139 B1 * 4/2014 Hurrell ..... A01M 31/006 294/169
8,764,081 B1 * 7/2014 Krieger ..... A44B 19/262 24/429
2007/0006366 A1 * 1/2007 Barnard ..... A44B 19/262 2/227
2013/0341940 A1 12/2013 Taurman
2015/0246774 A1 * 9/2015 Fernandes ..... B65G 7/12 414/800

FOREIGN PATENT DOCUMENTS

GB 1089357 11/1967

* cited by examiner

*Primary Examiner* — Robert Sandy
*Assistant Examiner* — Michael S Lee

(57) ABSTRACT

A zipper operating device for operating a zipper attached to a garment and traversing part of a back of a user includes an elongated rod being rigid and having a first end and a second end. A hook is pivotably coupled to the first end of the elongated rod and is configured for insertion into an eyelet of a slider of a zipper. A method for using the device includes providing a garment with a zipper that traverses a portion of a back of a user. The hook is inserted into the eyelet and the elongated rod is moved such that the hook engages the slider to open or close the zipper.

10 Claims, 4 Drawing Sheets

In Use View

METHOD AND ASSEMBLY FOR ASSISTING SOMEONE TO OPERATE A ZIPPER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to zipper operating devices and more particularly pertains to a new zipper operating device for operating a zipper attached to a garment and traversing part of a back of a user.

(2) Description of Related Art Including Information Disclosed Under 37 CFR 1.97 and 1.98

The prior art relates to zipper operating devices which are operated by a user when donning or removing a garment with a back-positioned zipper. Zipper operating devices typically have either a rigid elongated rod or a flexible line to which an engagement mechanism is attached at one end for engaging a zipper slider. Designs of zipper operating devices often include relatively elaborate mechanisms for engaging the slider which introduce unnecessary complexity that increases cost, manufacturing difficulties, and usage problems. Thus, a zipper operating device which addresses these problems is desired.

BRIEF SUMMARY OF THE INVENTION

An embodiment of the disclosure meets the needs presented above by generally comprising an elongated rod being rigid and having a first end and a second end. A hook is pivotably coupled to the first end of the elongated rod and is configured for insertion into an eyelet of a slider of a zipper.

Another embodiment of the disclosure includes a method comprising providing a zipper operating device having an elongated rod being rigid and having a first end and a second end. A hook is pivotably coupled to the first end of the elongated rod. The method further comprises providing a garment with a zipper positioned such that it traverses a portion of a back of a suer. The zipper has a slider with an eyelet. The hook is inserted into the eyelet, and the elongated rod is moved such that the hook engages the slider to open or close the zipper.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
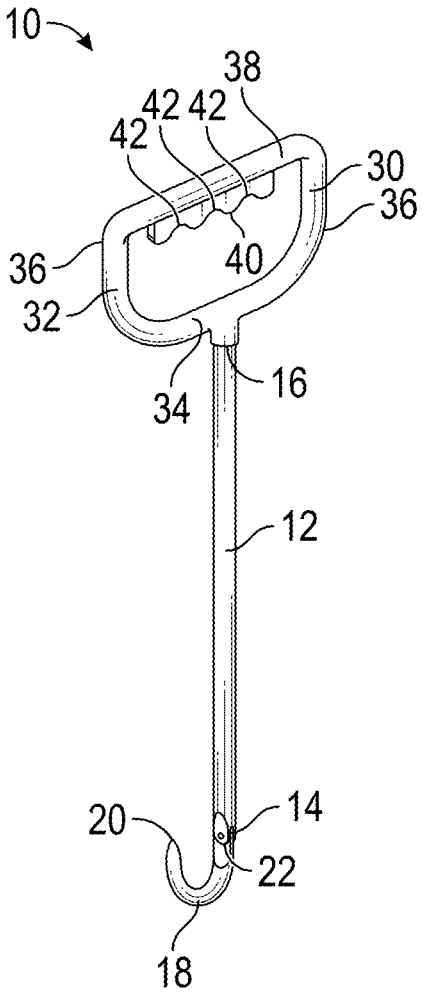
FIG. 1 is a top perspective view of a zipper operating device according to an embodiment of the disclosure.
Figure 2:
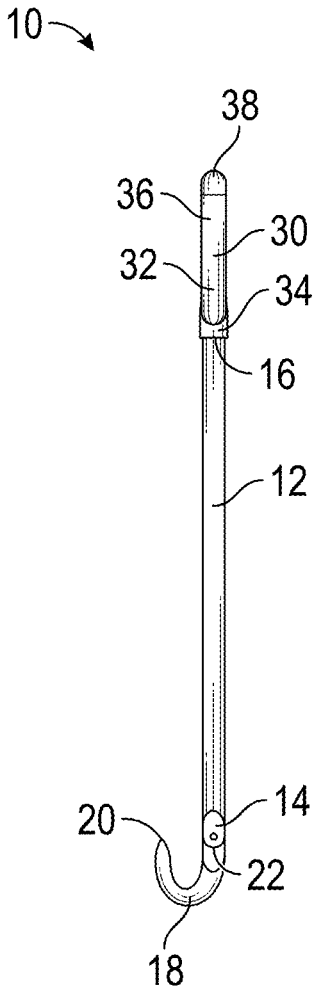
FIG. 2 is a side view of an embodiment of the disclosure.
Figure 3:
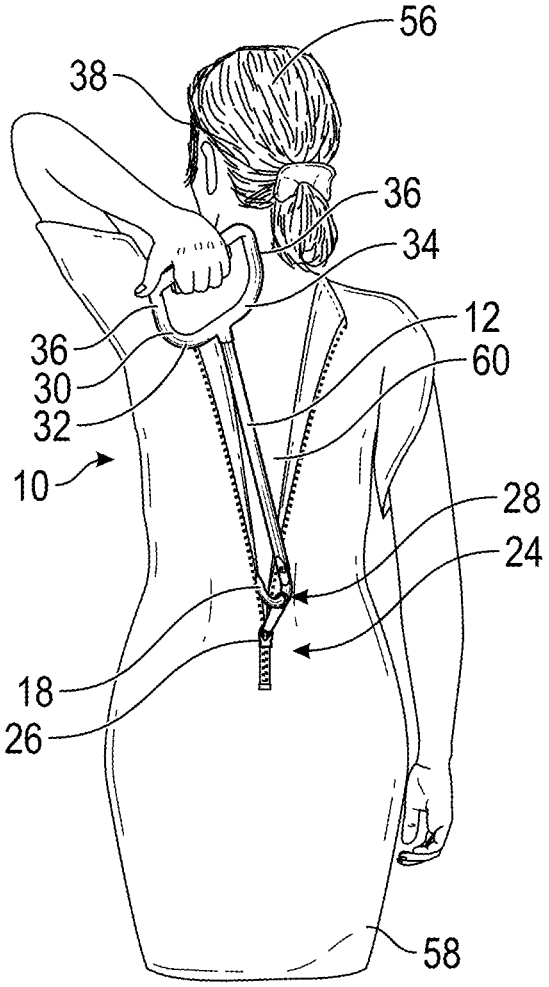
FIG. 3 is an in-use view of an embodiment of the disclosure.

With reference now to the drawings, and in particular to FIGS. 1 through 5 thereof, a new zipper operating device embodying the principles and concepts of an embodiment of the disclosure and generally designated by the reference numeral 10 will be described.

As best illustrated in FIGS. 1 through 5, the zipper operating device 10 generally comprises an elongated rod 12 having a first end 14 and a second end 16. The elongated rod 12 is rigid and typically has a length from the first end 14 to the second end 16 that is between 12.0 inches and 16.0 inches. Typically, a conventional rigid material is used, such as wood, metal, plastic, or the like. A hook 18 is pivotably coupled to the first end 14 of the elongated rod 12 and is configured for insertion into an eyelet 28 of a slider 26 of a zipper 24. The hook 18 has a free end 20 and an attached end 22. The free end 20 is typically pointed to facilitate insertion of the hook 18 into the eyelet 28.

A handle 30 is coupled to the second end 16 of the elongated rod 12. The handle 30 may form a closed loop 32 which includes a base 34, a pair of legs 36, and a grip 38. The base 34 is attached to and extends in opposite directions from the elongated rod 12. The pair of legs 36 is attached to and extends upwardly from the base 34. The grip 38 is attached to the legs 36 and is spaced from the base 34. The grip 38 typically has a bottom surface 40 with a plurality of finger indentations 42 positioned therein to facilitate gripping of the handle 30.

Figure 4:
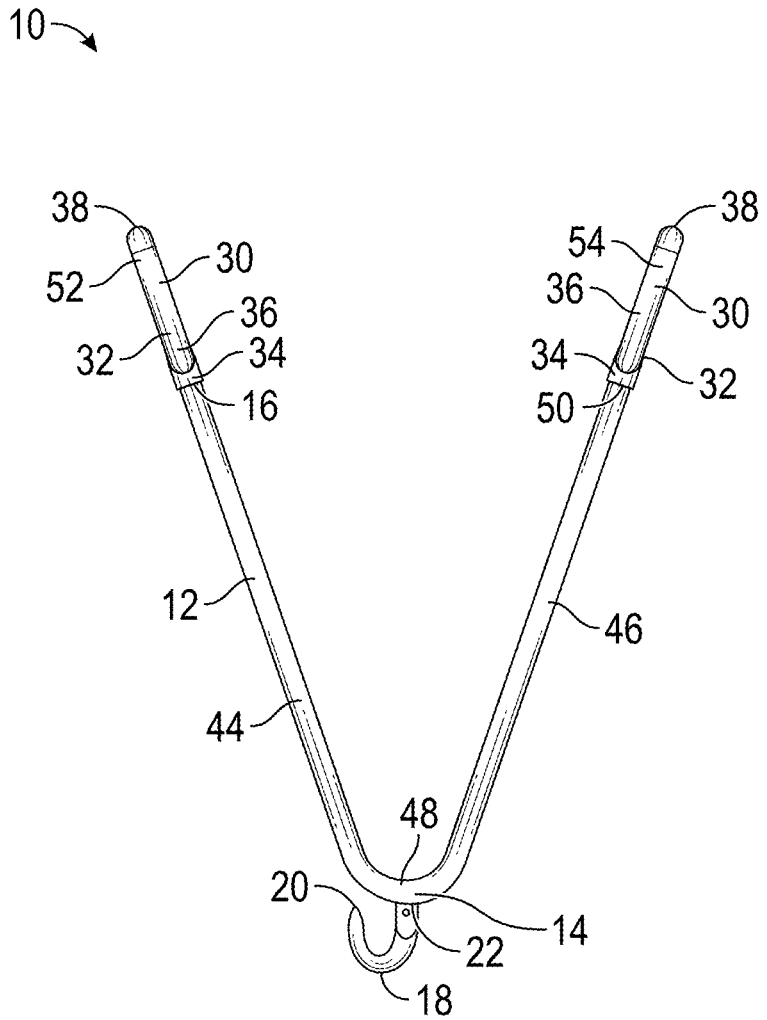
FIG. 4 is a front view of an alternative embodiment of the disclosure.
Figure 5:
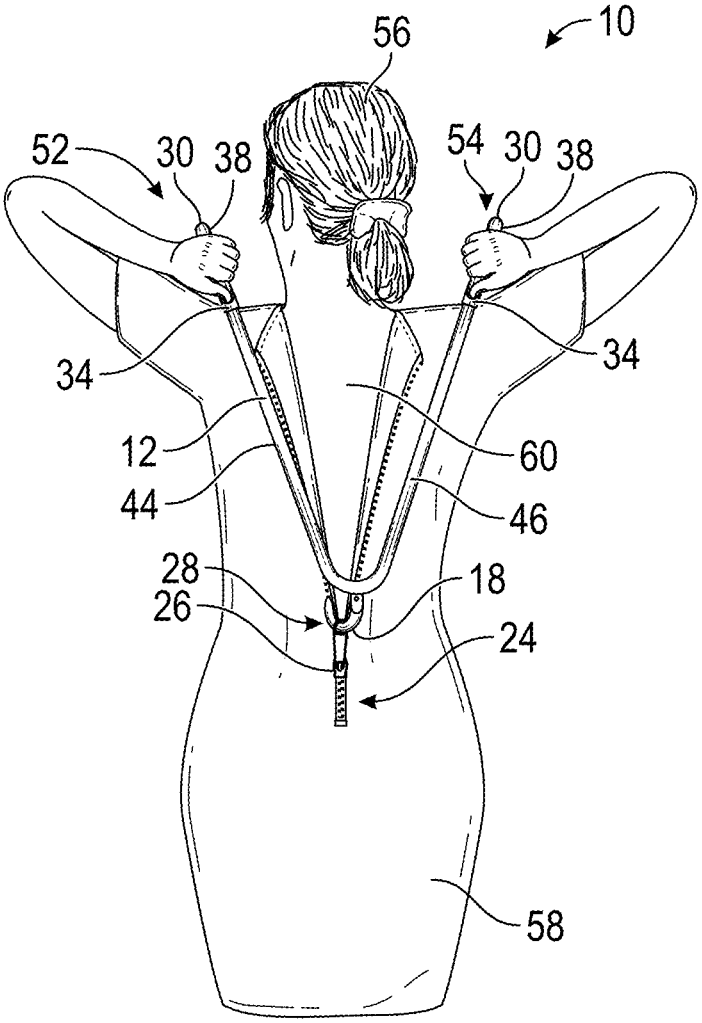
FIG. 5 is an in-use view of an alternative embodiment of the disclosure.

In an alternative embodiment as shown in FIGS. 4 and 5, the elongated rod 12 defines a first elongated rod 44. A second elongated rod 46 has a first end 48 and a second end 50. The first end 48 of the second elongated rod 46 is coupled to the first end 14 of the first elongated rod 44 such that the second elongated rod 46 forms an acute angle with the first elongated rod 44, which may be from 10° to 45°. The second elongated rod 46 is also rigid and typically has a same length as the length of the first elongated rod 44. The second elongated rod 46 will typically be constructed of the same material as the first elongated rod 44. In the alternative embodiment the handle 30 defines a first handle 52 attached to the first elongated rod 44. A second handle 54 coupled to the second end 50 of the second elongated rod 46. The second handle 54 has a same shape and size as the first handle 52.

In use, a user 56 inserts the hook 18 into the eyelet 28 of the slider 26 of the zipper 24. The user 56 then grips the grip 38 of the handle 30 and moves the handle 30 such that the hook 18 engages the slider 26 to open or close the zipper 24 as desired by the user 56. The user 56 may grip and move one or both the first handle 52 and the second handle 54 of the alternative embodiment to engage the slider 26 to open or close the zipper 24. In particular, the zipper 24 operating device 10 may be used to open and close a zipper 24 attached to a garment 58 worn by the user 56 which traverses a portion of a back 60 of the user 56.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A zipper operating device comprising:

an elongated rod having a first end and a second end, the elongated rod being rigid, the elongated rod defining a first elongated rod;

a second elongated rod having a first end and a second end, the first end of the second elongated rod being coupled to the first end of the first elongated rod, the second elongated rod forming an acute angle with the first elongated rod, the second elongated rod being rigid; and a hook being pivotably coupled to the first end of the elongated rod, the hook being configured for insertion into an eyelet of a slider of a zipper.

2. The device of claim 1, further comprising the elongated rod having a length from the first end to the second end being between 12.0 inches and 16.0 inches.

3. The device of claim 1, further comprising the hook having a free end and an attached end, the free end being pointed to facilitate insertion of the hook into the eyelet.

4. The device of claim 1, further comprising a handle being coupled to the second end of the elongated rod, the handle forming a closed loop, the closed loop including a base being attached to and extending in opposite directions from the elongated rod, a pair of legs being attached to and extending upwardly from the base, and a grip being attached to the legs and being spaced from the base.

5. The device of claim 4, further comp sing:

the handle defining a first handle; and a second handle being coupled to the second end of the second elongated rod, the second handle having a same shape and size as the first handle.

6. The device of claim 5, further comprising the second elongated rod having a same length as the length of the first elongated rod.

7. The device of claim 1, further comprising the second elongated rod having a same length as the length of the first elongated rod.

8. A zipper operating device comprising:

an elongated rod having a first end and a second end, the elongated rod being rigid;

a hook being pivotably coupled to the first end of the elongated rod, the hook being configured for insertion into an eyelet of a slider of a zipper:

a handle being coupled to the second end of the elongated rod, the handle forming a closed loop, the closed loop including a base being attached to and extending in opposite directions from the elongated rod, a pair of ley being attached to and extending upwardly from the base, and a grip being attached to the legs and being spaced from the base, the grip having a bottom surface having a plurality of finger indentations positioned therein to facilitate gripping of the handle.

9. A zipper operating device comprising:

an elongated rod having a first end and a second end, the elongated rod being rigid, the elongated rod having a length from the first end to the second end being between 12.0 inches and 16.0 inches;

a hook being pivotably coupled to the first end of the elongated rod, the hook being configured for insertion into an eyelet of a slider of a zipper, the hook having a free end and an attached end, the free end being pointed to facilitate insertion of the hook into the eyelet; and a handle being coupled to the second end of the elongated rod, the handle forming a closed loop, the closed loop including a base being attached to and extending in opposite directions from the elongated rod, a pair of legs being attached to and extending upwardly from the base, and a grip being attached to the legs and being spaced from the base, the grip having a bottom surface having a plurality of finger indentations positioned therein to facilitate gripping of the handle.

10. The device of claim 9, further comprising:

the elongated rod defining a first elongated rod;

a second elongated rod having a first end and a second end, the first end of the second elongated rod being coupled to the first end of the first elongated rod, the second elongated rod forming an acute angle with the first elongated rod, the second elongated rod being rigid, the second elongated rod having a same length as the length of the first elongated rod;

the handle defining a first handle; and a second handle being coupled to the second end of the second elongated rod, the second handle having a same shape and size as the first handle.

* * * * *